United States Patent [19]

Chen

[11] Patent Number: 5,005,221

[45] Date of Patent: Apr. 9, 1991

[54] MOTORCYCLE HELMET WIND VISOR ADJUSTMENT DEVICE

[76] Inventor: Lee S. Chen, No. 343, Chung Chen Rd., Yung Kang Hsiang, Tainan Hsien, Taiwan

[21] Appl. No.: 399,245

[22] Filed: Aug. 28, 1989

[51] Int. Cl.[5] ..... A61F 9/06

[52] U.S. Cl. ..... 2/424; 2/425

[58] Field of Search ..... 2/410, 424, 425, 15

[56] References Cited

U.S. PATENT DOCUMENTS

| | | | |
|---|---|---|---|
| 2,944,263 | 7/1960 | Rayburn et al. | 2/9 |
| 3,274,613 | 9/1966 | Sowle | 2/9 |
| 4,305,160 | 12/1981 | Sundahl | 2/424 |
| 4,807,305 | 2/1989 | Sundahl | 2/424 |
| 4,885,806 | 12/1989 | Heller | 2/425 X |
| 4,907,299 | 3/1990 | Arai | 2/424 |

FOREIGN PATENT DOCUMENTS

| | | | |
|---|---|---|---|
| 1560723 | 2/1980 | United Kingdom | 2/424 |
| 2052244 | 1/1981 | United Kingdom | 2/424 |
| 2087222 | 5/1982 | United Kingdom | 2/425 |
| 2153003 | 8/1985 | United Kingdom | 2/410 |

*Primary Examiner*—Allan N. Shoap
*Assistant Examiner*—Scott Cummings
*Attorney, Agent, or Firm*—Keaty & Keaty

[57] ABSTRACT

A wind visor for motorcycle helmets having two visor rings, with friction tracks on them, on each distal end of the wind visor which rotatably engage with a respective slip ring. The slip ring is in turn engaged with a flexible U-shaped bracket, which in turn is fixed by a bolt to the motorcycle helmet. A cover plate is fixable over each of the visor rings and the associated parts for aesthetic purposes.

1 Claim, 4 Drawing Sheets

MOTORCYCLE HELMET WIND VISOR ADJUSTMENT DEVICE

BACKGROUND OF THE INVENTION

This invention relates to motorcycle helmets, and more particularly relates to a motorcycle helmet with a hidden wind visor adjustment device.

In the past, motorcycle helmets did not often have adjustable wind visors fitted. For those helmets that did have adjustable wind visors fitted, the wind visors were adjustable and fixable to only a narrow range of angular orientations. Furthermore, the previous wind visors for motorcycle helmets were not fixable at various orientations according to the need of the motorcyclist. For instance, on very rainy days, the wind visor would of course be put all the way down. However, on hot, sunny days when the sun is high in the sky, the motorcyclist may wish to flip the wind visor partially upwards to a fixed position so as to let some fresh air in, and at the same time block the sun. As the sun gets lower in the sky, the motorcyclist may wish to readjust the orientation of the wind visor according to the angle of the sun in the sky. However, with conventional wind visors this feature has not been available.

It is the purpose of this present invention, therefore, to mitigate and/or obviate the above-mentioned drawbacks in the manner set forth in the detailed description of the preferred embodiment.

SUMMARY OF THE INVENTION

A primary objective of this invention is to provide a motorcycle helmet which incorporates an adjustable wind visor.

Another objective of this invention is to provide such an adjustable wind visor which is attractive and frictionally fixable in a wide range of positions.

Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
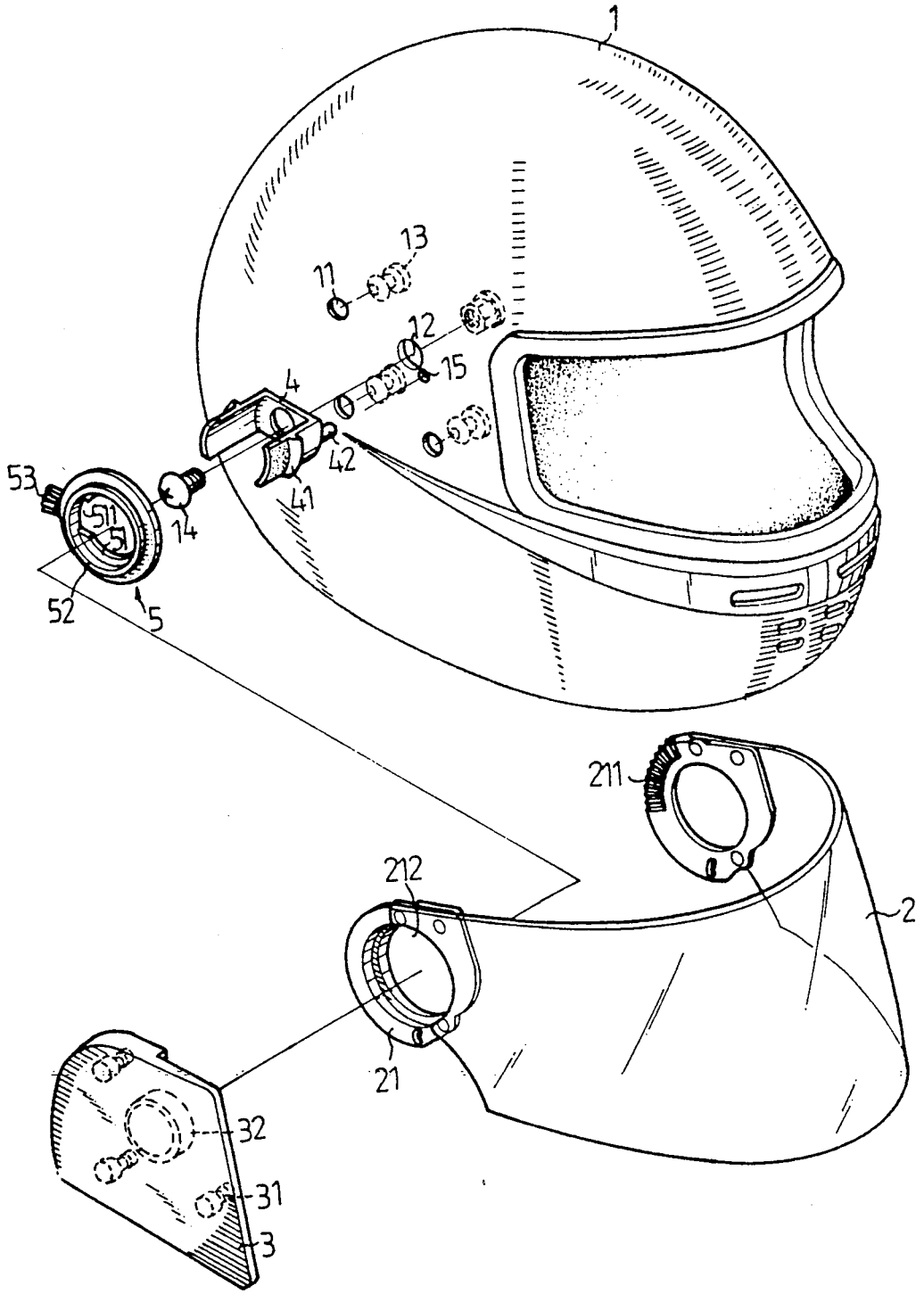
FIG. 1 is an exploded view of a motorcycle helmet with adjustable wind visor in accordance with the present invention.
Figure 2:
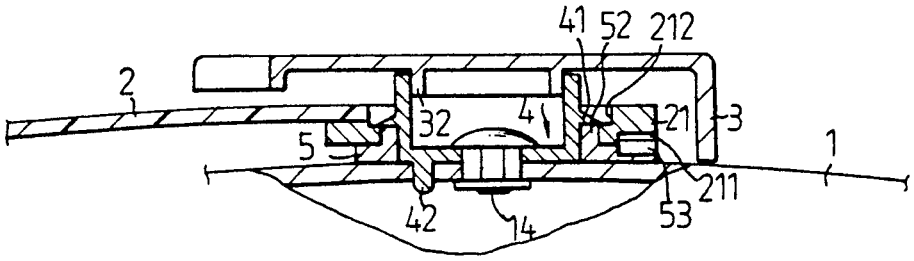
FIG. 2 is a cutaway cross-sectional view showing the structure around the adjustment portion of the helmet with adjustable wind visor in accordance with the present invention.
Figure 3:
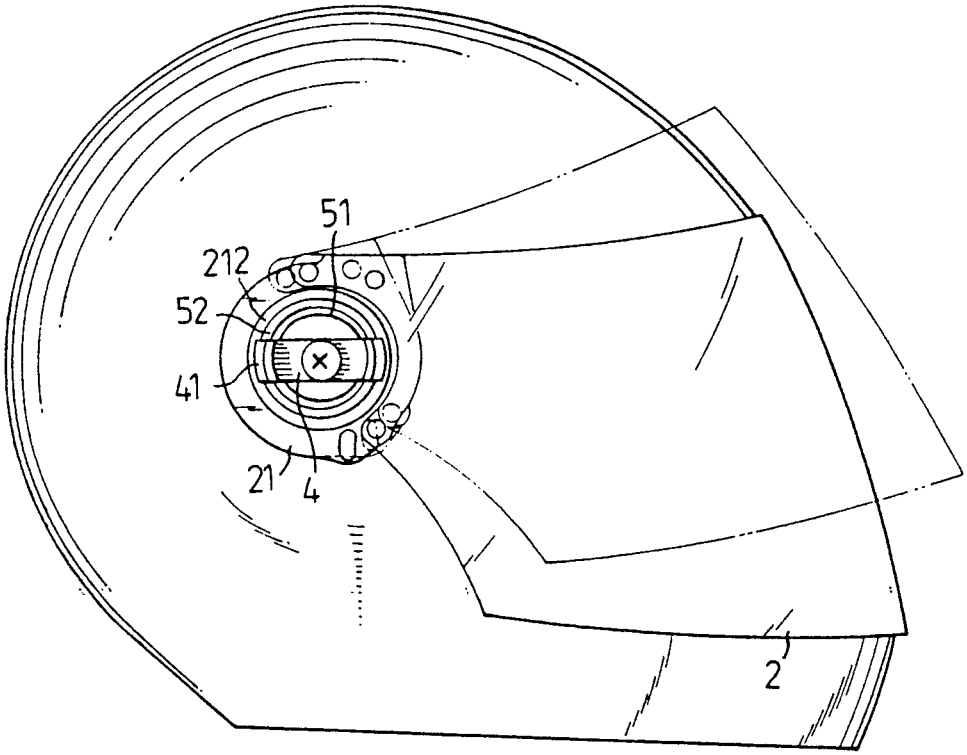
FIG. 3 is an elevational view of the helmet with adjustable wind visor in accordance with the present invention, excluding the wind visor adjustment device cover plate.
Figure 4:
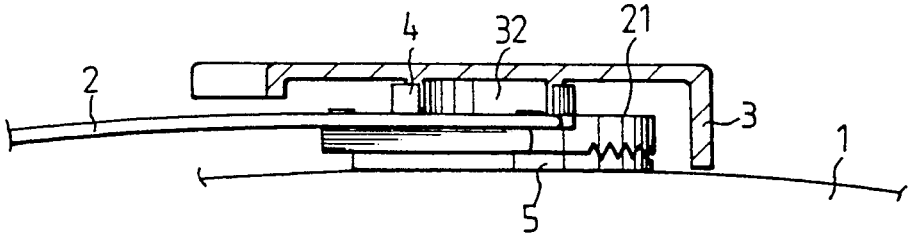
FIG. 4 is a top, partially sectioned, view of the adjustment portion of the helmet with adjustable wind visor in accordance with the present invention.

Referring to FIGS. 1 to 4, it can be seen that the present invention comprises a motorcycle helmet (1), a wind visor (2), a U-shaped bracket (4), a slip ring (5), and a cover plate (3).

The wind visor (2) has respective visor rings (21) on each of its distal ends, and each said visor ring (21) has a friction track (211) on its outer surface. Each said visor ring (21) also has an annular seat (212) on the inner circumference thereof.

The slip ring (5) has an annular protrusion (52) thereon for rotatably engaging with the annular seat (212). The slip ring (5) also has a friction piece (53) thereon for frictionally engaging with the friction track (211). The slip ring (5) has inner walls (51) on an inner circumference thereof with two securement slots (511) diametrically-oppositely spaced therebetween.

The U-shaped bracket (4) has a center portion with a hole therethrough and two side portions. Each of the side portions has a respective catch (41) on an outer surface thereof. The two side portions are flexible so as to be engageable with the securement slots (511). The U-shaped bracket (4) has a hole on the center portion thereof so as to be securable by a bolt (14) to the motorcycle helmet (1). A fixing post (42) protrudes from one side of the center portion for engaging with a fixing hole (15) on the motorcycle helmet, preventing rotation of the U-shaped bracket (4).

The cover plate (3) is provided to cover the visor ring (21), slip ring (5), and the U-shaped bracket (4), thereby giving the helmet a much more aesthetically pleasing design. The cover plate (3) has an annular wall (32) on an inner surface thereof which is frictionally engageable with an inner surface of the U-shaped bracket (4). The cover plate (3) has a plurality of evenly spaced fixing stubs (31) protruding from its inner surface. The motorcycle helmet (1) has a plurality of engagement holes (11) which correspond to the fixing stubs (31), with the fixing stubs (31) fitting through the engagement holes (11) and fixably engaging with a respective plurality of receptacles (13).

To use the present invention, the user simply moves the wind visor (2) to a desired angular orientation. The ring (21) is frictionally fixable at a wide range of angles about the slip ring (5).

As various possible embodiments might be made of the above invention without departing from the scope of the invention, it is to be understood that all matter herein described or shown in the accompanying drawing is to be interpreted as illustrative and not in a .pa limiting sense. Thus it will be appreciated that the drawings are exemplary of a preferred embodiment of the invention.

I claim:

1. A motorcycle helmet wind visor adjustment device for a motorcycle helmet comprising:

(a) a wind visor (2) with respective visor rings (21) on each distal end thereof, each said visor ring (21) having a friction track (211) on an outer surface thereof, each said visor ring (21) also having an annular seat (212) on an inner circumference thereof;

(b) a slip ring (5) which has an annular protrusion (52) thereon for rotatably engaging said annular seat (212), said slip ring (5) also having a friction piece (53) thereon for frictionally engaging with said friction track (211), said slip ring (5) having inner walls (51) on a radially inner circumference thereof seperated by two diametrically opposite securement slots (511);

(c) a U-shaped bracket (4) having a center portion with a hole therethrough and two side portions, said side portions each having a respective catch (41) on an outer surface thereof for engagement with said annular protrusion (52), said two side portions being flexible so as to be engageable with said securement slots (511), said U-shaped bracket (4) being securable by a bolt (14) at said center portion thereof to said motorcycle helmet, a fixing post (42) protruding from said center portion away from said side portions for engaging with a fixing hole (15) on said motorcycle helmet so as to prevent rotation of said U-shaped bracket (4);

(d) a cover plate (3) for covering said visor ring (21), slip ring (5), and said U-shaped bracket (4); said cover plate (3) having an annular wall (32) on an inner surface thereof which is frictionally engageable with an inner surface of each side portion said U-shaped bracket (4), said cover plate (3) having a plurality of evenly spaced fixing stubs (31) protruding from said inner surface thereof, said motorcycle helmet having a plurality of engagement holes (11) corresponding to said fixing stubs (31), said fixing stubs (31) fitting through said engagement holes (11) and fixably engaging with a plurality of receptacles (13); and said visor ring (21) being fixable at a wide range of angles about said slip ring (5).

* * * * *